United States Patent [19]

Bovenkerk

[11] Patent Number: 4,476,656

[45] Date of Patent: Oct. 16, 1984

[54] METHOD OF DRESSING A PLATED CUBIC BORON NITRIDE GRINDING WHEEL

[75] Inventor: Harold P. Bovenkerk, Worthington, Ohio

[73] Assignee: General Electric Company, Worthington, Ohio

[21] Appl. No.: 322,346

[22] Filed: Nov. 18, 1981

[51] Int. Cl.[3] ..... B24B 1/00

[52] U.S. Cl. ..... 51/325; 125/11 R

[58] Field of Search ..... 125/15, 11 R, 11 CD; 51/325

[56] References Cited

U.S. PATENT DOCUMENTS

| | | | |
|---|---|---|---|
| 3,691,707 | 9/1972 | Von Arx | 125/15 |
| 4,182,082 | 1/1980 | Meyer | 125/11 R |
| 4,289,503 | 9/1981 | Corrigan | 51/307 |
| 4,300,522 | 11/1981 | Henry | 125/11 R |

FOREIGN PATENT DOCUMENTS 690047 4/1953 United Kingdom .

*Primary Examiner*—Harold D. Whitehead

*Attorney, Agent, or Firm*—Robert R. Schroeder; Douglas B. Little

[57] ABSTRACT

A dressing method has been devised for plated grinding wheels having relatively coarse mesh microcrystalline cubic boron nitride abrasive. The method comprises lightly grinding cemented metal carbide (e.g. cobalt cemented tungsten carbide) with the grinding wheel before grinding the intended workiece. Wheels dressed in this manner have been found to obtain good surface finishes (16–18 RMS) while maintaining a free cutting aggressive action which gives high grinding rates.

3 Claims, 1 Drawing Figure

METHOD OF DRESSING A PLATED CUBIC BORON NITRIDE GRINDING WHEEL

DESCRIPTION

1. Technical Field

Figure 1:
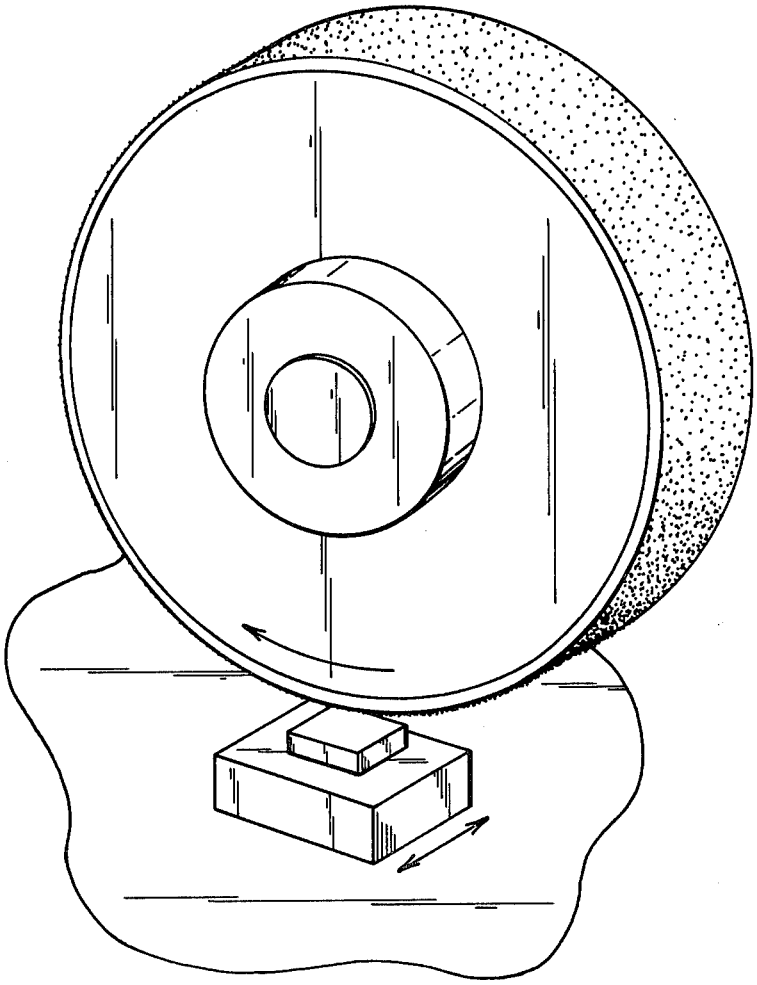

This invention relates to methods for dressing grinding wheels. More particularly, it relates to dressing electroplated grinding wheels containing cubic boron nitride abrasive grit.

2. Background

Dressing may be defined as any operation performed on the face of a grinding wheel which improves its cutting action. Trueing is a dressing operation but is more precise, i.e., the face of the wheel may be made parallel to the grinding wheel spindle or made into a radius or special shape by trueing. Dressing and trueing are accomplished through the use of a variety of tools, such as rotary dressers, trueing brakes, and single point and multiple point diamond dressing tools. Dressing is performed with such a tool by engaging the periphery of the rotating grinding wheel with the tool.

The manufacture of electroplated grinding wheels is known to the art. They can be manufactured by electroplating nickel onto a suitable substrate cathode which is in contact with a quantity of abrasive grits, such as cubic boron nitride (CBN). Sufficient nickel is electroplated onto the substrate (e.g. steel) to tack down and retain the grinding grit on the surface of the wheel. One electroplating bath which may be used is known as a Watts bath, the composition of which is available in the literature.

Some references on nickel plated abrasive tools and electroplating in general are: Grenier, J. W. and Palovchik, S. T., "Electroplated Tools Fabrication and Performance,"presented at Diamond,—Partner in Productivity a Technical Symposium by Industrial Diamond Association of America, Inc., Nov. 11-12, 1974, Washington, D.C.; Ollard, E. A., *Introductory Electroplating,* Robert Draper Limited, Tedington, England, 1969; *Metal Finishing, 49th Guidebook-Directory Issue,* 1981, Metals and Plastics Publications, Inc., Hackensack, N.J.; Graham, K. A., *Electroplating Handbook,* 3rd ed., Van Nostrand Reinhold Co., N.Y., 1971; and Lowenheim, F. A., *Electroplating,* McGraw Hill Book Co., 1978.

U.S. Pat. No. 4,389,223 describes a type of cubic boron nitride especially developed for electroplated products. In particular, it is a microcrystalline CBN, especially treated to remove any surface electrically conducting phase which would interfere with electroplating. The CBN grit particles of this application are boron rich (i.e., have greater than the stoichiometric ratio of boron to nitrogen found in normal boron nitride), but it is believed that the treatment (an acid leaching process) removes elemental boron from the surface of the grits.

One embodiment of this type of CBN consists essentially of single crystal, catalyst grown CBN embedded in a matrix of boron-rich polycrystalline CBN which has been made from graphitic hexagonal boron nitride. The catalyst grown CBN can be prepared by the well known catalytic high pressure/high temperature technique (see U.S. Pat. No. 3,150,929; 3,192,015; 3,701,826; 3,918,931; and 3,959,443). The manufacture of the microcrystalline grit containing the catalyst grown single crystals is disclosed in U.S. Pat. No. 4,289,503, while the surface treatment process is taught in U.S. Pat. No. 4,389,223.

The surface treatment process to make the grit more amenable to electroplating comprises leaching the cubic boron nitride with an acid mixture seletected from the group consisting of nitric/sulfuric acid mixtures and phosphoric/sulfuric acid mixtures for a sufficient time to remove any surface conducting phase. For example, a mixture of nitric and sulfuric acids (initial mole ratio of nitric to sulfuric acid of 0.017 to 2.43) at a temperature of between 100° and 300° C. could be used to leach the grit for a time of from 10 minutes to 12 hours.

The graphitic boron nitride used to make the type of CBN described in the paragraph above is a variety of hexagonal boron nitride which is distinguished from turbostratic boron nitride. The turbostratic structure is characteristic of pyrolytic boron nitride and is a continuous strcture characterized by two-dimensional layers of hexagonal rings stacked at irregular intervals and randomly oriented. Graphitic boron nitride (GBN) generally has a more ordered crystal structure than turbostratic or pyrolytic boron nitride. The boron and nitrogen atoms are believed to form more or less parallel stacks of fused boron nitride layers in the hexagonal lattice, with the stacking being fairly ordered in translation parallel to the layers and also in rotation about the normal to the layers. In other words, there are fewer imperfections and distortions within the GBN structure. GBN has a density of about 2.28 g/cm$^3$ and an interlayer spacing of about 3.33 angstroms. The structure in any mass of GBN is continuous in any given direction, as opposed to being separated by crystal boundaries. The material is generally soft, flaky and light in color.

Further details on the two forms of hexagonal boron nitride may be found in Thomas, J. et al, "Turbostratic Boron Nitride, Thermal Transformations to Ordered-layer-lattice Boron Nitride," *J. A. C. S.,* vol. 84, (Jan. 25, 1963) p. 4619; and Economy, J. and Anderson, R., "Boron Nitride Fibers," *J. Polymer Science: Part C,* No. 19,(1967) p. 283.

Normally, abrasive wheels, made by the electroplating method of metal entraining the grit on a metallic surface, are not dressed. In fact, such wheels are advertised as not to be dressed, or dressing is not recommended. The reason for this is the single layer of abrasive which retained in the electroplated metal bonded to the substrate might be stripped from the surface or fractured so that no protusion exists above the level of the bonding metal. In either case, the usefulness of the wheel is effectively destroyed.

However, in the case of plated grinding wheels made with the microcrystalline CBN grit described above, although the wheels demonstrate remarkably high grinding rates (in the order of 0.62 in$^3$/min.), the surface furnish on the workpiece is poor. The reason for this poor surface finish is thought to be the non-uniformity of the height of protusion of the grinding grits from the electroplated metal bond, giving high spots on the wheel. Thus, the problem presented is how to improve the workpiece finish without degenerating the grinding wheel performance.

DISCLOSURE OF INVENTION

This problem has been solved by dressing the plated CBN grinding wheel not with a normal dressing tool, but by grinding a cemented metal carbide block (e.g. cobalt cemented tungsten carbide) before the wheel is used on the intended workpiece. The thought behind this was that, although single crystal catalyst grown CBN grit will not normally grind cemented carbide in a resinoid wheel, the higher grit strength and the microcrystallinity of the CBN grit described in the background section above might allow the wheel to grind carbide and allow removal of the high spots from the wheel without gross fracture of the grits. This would present the wheel to the intended workpiece with more cutting grits and more cutting points per grit.

Through this dressing technique, the surface finish on the workpiece is improved, and the grinding wheel still grinds at a high rate. The plated wheel with the microcrystalline CBN grit has been found to grind metal carbide quite well, at a rate orders of magnitude better than other CBN grits (e.g. single crystal, catalyst grown CBN). More importantly, after such conditioning, the plated wheel will grind relatively soft steel with a substantially improved and satisfactory surface finish, while maintaining high grinding rates. cl BRIEF DESCRIPTION OF THE DRAWING FIG. 1 is a front elevation view in simplified form of a grinding wheel and dressing tool positioned to utilize the dressing process of this invention.

BEST MODE FOR CARRYING OUT THE INVENTION

In commercial metal working, surface finish or roughness is based upon the absolute values of the measured profile height deviations of the surface from a graphical or nominal center line within the sampling length. One of the common ways of expressing values of surface finish or roughness is RMS, or the root mean square of the absolute values of those profile height deviations in microinches. A value of about 50 to 60 RMS would normally be unacceptable, and finish grinding would be required. A value of about 32 RMS is considered a commercially acceptable finish for commercial grades of steel used in machinery and tools.

The invention will be further clarified by a consideration of the following example which is intended to be purely exemplary. The plate surface grinding wheel used had the following characteristics: 12 inch (300 mm.) diameter, ½ inch (12 mm.) width, using CBN grit characterized as 30/40 mesh size (600/425 micron) aggregated cubic boron nitride consisting essentially of single crystal, catalyst grown CBN embedded in a matrix of boron rich polycrystalline cubic boron nitride made from graphitic hexagonal boron nitride (obtained as BORAZON 570 CBN from General Electric Company) in a concentration on the wheel of about 0.31 carats per square centimeter (2 carats/in$^2$). The intended workpiece was a relatively low carbon soft alloy steel, American Iron and Steel Institute grade 1020 (not heat treated or hardened). The grinding conditions were: wheel speed of 5,498 surface feet per minute (1,676 per minute), depth of cut ½ inch (3 mm.) per pass, table speed 10 inch/min. (250 mm./min), straight oil used as coolant.

The surface finish achieved under the above stated conditions before any dressing of the plated wheel was 80–85 RMS. The wheel was then dressed by traversing a one inch square block of cobalt cemented tungsten carbide (6% cobalt and 94% tungsten carbide, obtained as Carboloy ® grade 44 A from General Electric Company) under the following conditions: 4 passes of the grinding wheel at the surface speed stated above and at a depth of 0.001 inch (0.025 mm.). After dressing in this manner, a new 10 inch long by ½ inch wide slot was ground into the AISI 1020 steel workpiece under the conditions stated above, and the surface finish obtained was 60–65 RMS. After dressing the wheel again in the manner previously stated with an additional 4 passes over the tungsten carbide, a third slot was ground in the AISI 1020 steel workpiece, and a finish of 25–35 RMS was obtained. After dressing a third time by additional 4 passes over the tungsten carbide block, a fourth slot was ground into the low carbon steel workpiece, and a finish of 16–18 RMS was obtained. In all of these tests, a high material removal rate of about 0.625 in$^3$/min. (10.2 cm$^3$/min.) was maintained. By comparison, an ordinary aluminum oxide plated wheel would be expected to either burn the workpiece if made with a relatively hard bond or fail to hold its size if made with a relatively soft bond under such grinding conditions on such a workpiece. The relatively large amount of space between the grinding grits at such a low concentration on the wheel combined with coarse mesh size allows for the high removal rate.

Until this experiment was performed, it was unexpected that a commercial metal finish could be obtained with such a coarse mesh, free cutting, agressive grinding wheel. In light of this work, it is now expected that such results would be obtained with any similar grinding wheel manufactured with this type of abrasive at such low concentrations, using coarse mesh size grit (180 microns in largest dimension or larger).

Other embodiments of this invention will be apparent to those skilled in the art form a conderation of this specification or practice of the invention disclosed herein. Various omissions, modifications and changes to the principles described herein may be made by one skilled in the art without departing from the true scope and spirit of the invention which is indicated by the following claims.

I claim:

1. A method of dressing a plated grinding wheel made with a single layer of microcrystalline cubic boron nitride grit which method comprises rotating said grinding wheel and lightly grinding a cemented metal carbide with several passes of the grinding wheel before grinding the intended workpiece.

2. The dressing method of claim 1 which comprises making at least 8 passes of the grinding wheel over the cemented metal carbide at a wheel speed of about 1676 surface meters per minute and about 25 downfeed per pass.

3. A method of dressing a grinding wheel made with microcrystalline cubic boron nitride grit which method comprises rotating said grinding wheel and lightly grinding a cemented metal carbide with several passes of the grinding wheel before grinding the intended workpiece.

* * * * *